US005941411A

United States Patent [19]

Langenbach

[11] Patent Number: 5,941,411

[45] Date of Patent: Aug. 24, 1999

[54] DRINKING CUP AND RELEASABLY ATTACHED EATING UTENSIL

[76] Inventor: Klaus Langenbach, Bachstrasse 14,59558, Lippstadt, Germany

[21] Appl. No.: 09/038,618

[22] Filed: Mar. 11, 1998

[51] Int. Cl.[6] ..... B65D 25/52

[52] U.S. Cl. ..... 220/735; 220/703; 220/756

[58] Field of Search ..... 220/703, 735, 220/736, 752, 756, 574.1, 23.4, 23.83, 23.86

[56] References Cited

U.S. PATENT DOCUMENTS

| | | | |
|---|---|---|---|
| 1,393,574 | 10/1921 | Rohmiller | 220/735 |
| 2,034,940 | 3/1936 | Butler | 220/756 |
| 2,438,434 | 3/1948 | Friedman | 220/735 |
| 2,485,303 | 10/1949 | Marcus | 220/735 |
| 2,918,203 | 12/1959 | Hodgson | 220/735 |
| 4,789,064 | 12/1988 | Segal | 220/735 |
| 4,863,033 | 9/1989 | Buj | 220/735 |
| 5,105,963 | 4/1992 | Scott | 220/735 |
| 5,222,622 | 6/1993 | Laske, Jr. | 220/574.1 |
| 5,634,569 | 6/1997 | DeCoster | 220/735 |

FOREIGN PATENT DOCUMENTS

| | | | |
|---|---|---|---|
| 662503 | 5/1963 | Canada | 220/574.1 |
| 14967 | of 1892 | United Kingdom . | |

*Primary Examiner*—Stephen Castellano
*Attorney, Agent, or Firm*—William E. Noonan

[57] ABSTRACT

A combined drinking cup and releasably attached eating utensil device includes a cup and a cup handle attached to and extending outwardly from the cup. An eating utensil includes a slot that receives the cup handle to mount the utensil on the handle in interengagement with the cup.

11 Claims, 3 Drawing Sheets

DRINKING CUP AND RELEASABLY ATTACHED EATING UTENSIL

FIELD OF THE INVENTION

This invention relates to a drinking cup and an eating utensil, which is releasably attached to the drinking cup.

BACKGROUND OF THE INVENTION

A number of known drinking cups feature a releasably attached spoon, which enables the user to stir or eat the contents of the cup. Such devices are especially useful for travel, camping, cookouts and other outdoor activities. Unfortunately, these products are often inconvenient to use and wash. The attached utensil usually interferes with drinking and must be removed before the cup can be used. One known product does employ a cup having a recessed handle that receives a spoon. However, the user cannot put his or her finger through this handle with the spoon attached and it is therefore somewhat awkward to hold the cup for drinking. To properly grasp the handle, the spoon must first be removed. Once separated from the cup, the utensil is apt to be misplaced. None of the currently available combined cups and utensils are particularly attractive. There is a need for a product of this type, which has an improved, compact and ergonomically efficient design.

SUMMARY OF INVENTION

It is therefore an object of the present invention to provide a combined cup and removably attached utensil, wherein the cup may be conveniently and comfortably utilized for drinking without having to first detach the utensil from the cup.

It is a further object of this invention to provide a device wherein a spoon or other utensil is conveniently attached to a cup for use in stirring and eating the contents of the cup.

It is a further object of this invention to provide a cup and releasably attached utensil, which may be conveniently washed together in a dishwasher.

It is a further object of this invention to provide a device wherein a utensil is securely mounted to a cup and effectively resists unintentional disengagement from the cup.

This invention results from a realization that by forming a slot in a utensil and inserting the handle of the cup through that slot, the utensil can be attached to the cup and the cup can be used conveniently for drinking without first having to remove the utensil from the cup handle. This construction also provides for secure interengagement between the cup and the utensil and achieves an attractive and efficient cup and utensil design.

This invention features a drinking cup and releasably attached eating utensil device, which includes a cup and a cup handle attached to and extending outwardly from the cup. An eating utensil includes a slot through which the cup handle is inserted to mount said utensil on the cup handle.

In a preferred embodiment, the cup handle includes an upper, generally horizontal support surface from which the utensil depends. The cup may include a vertical channel that is formed in the outer surface thereof. The cup handle is typically attached to the cup within the channel and the utensil fits in the channel when the utensil is mounted on the cup handle. The utensil may include an elongate utensil handle in which the slot is formed.

At least one of the utensil and the cup handle may carry means for retaining the utensil on the cup handle in interengagement with the cup. Such means may include one or more protuberances carried by the cup handle. Preferably, the cup handle includes first and second sides. Each of the first and second sides may carry at least one protuberance. As a result, at least one protuberance is disposed on each side of the slot when the utensil is mounted on the handle. Typically, the utensil is composed of a resilient material and the slot is selectively expanded to permit the protuberances to pass therethrough when the utensil is selectively mounted on and removed from the handle. The cup handle may include a central opening through which a user's finger may be inserted. At least one protuberance may be formed along each side of the cup handle between the central opening and the channel.

The channel may include a substantially straight portion, which receives the utensil handle and a relatively wide portion which receives a head of the utensil when the utensil is mounted on the handle. The cup may include an upper end, lower end and a side wall that that extends from the upper end to the lower end. The upper end may include an opening and the cup may include a closed bottom that is recessed from the lower end of the cup.

DETAILED DESCRIPTION OF PREFERRED EMBODIMENTS

Other objects, features and advantages will occur from the following description of preferred embodiments and the accompanying drawings, in which.

Figure 1:
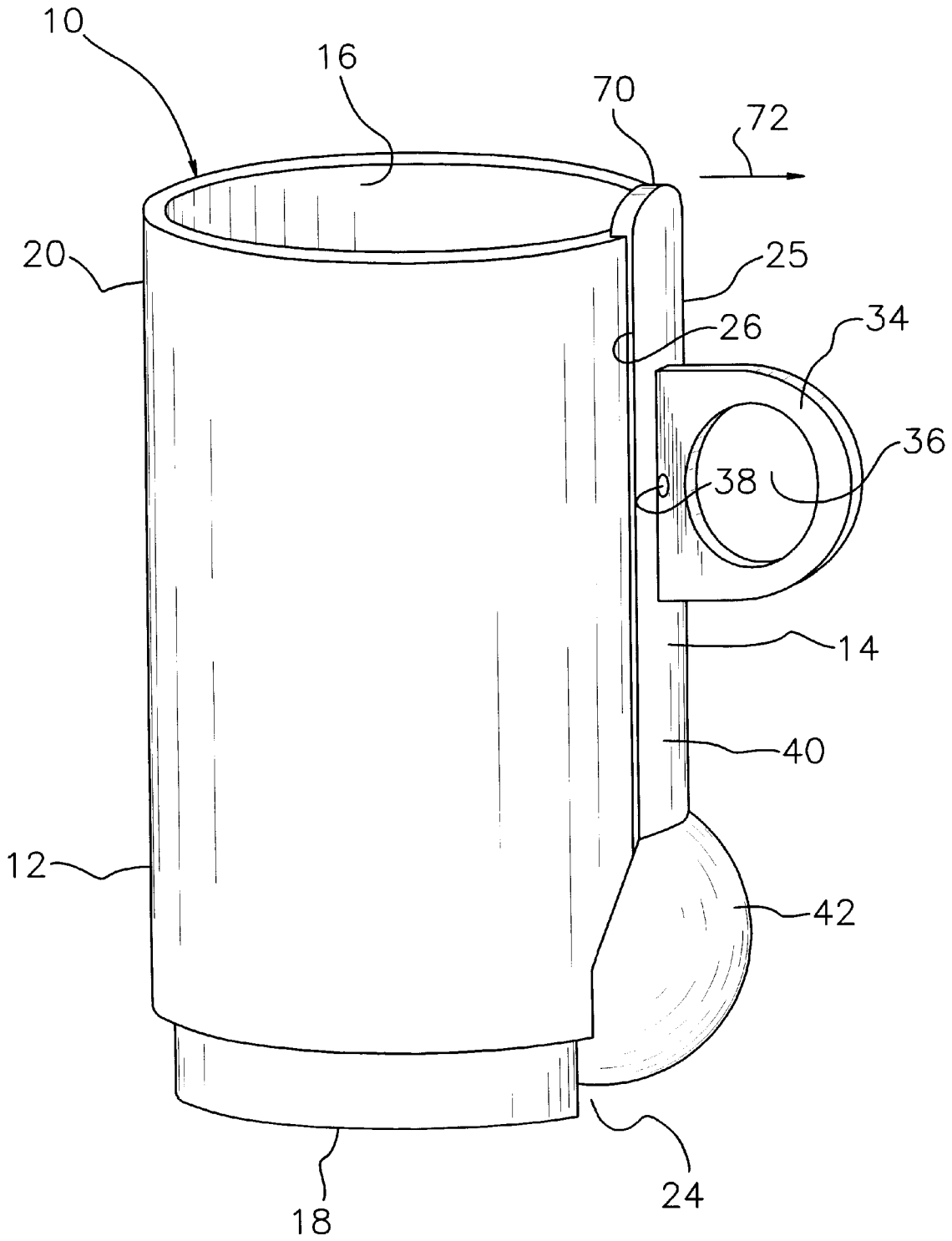
FIG. 1 is a perspective view of a combined drinking cup and releasably attached utensil in accordance with this invention.
Figure 2:
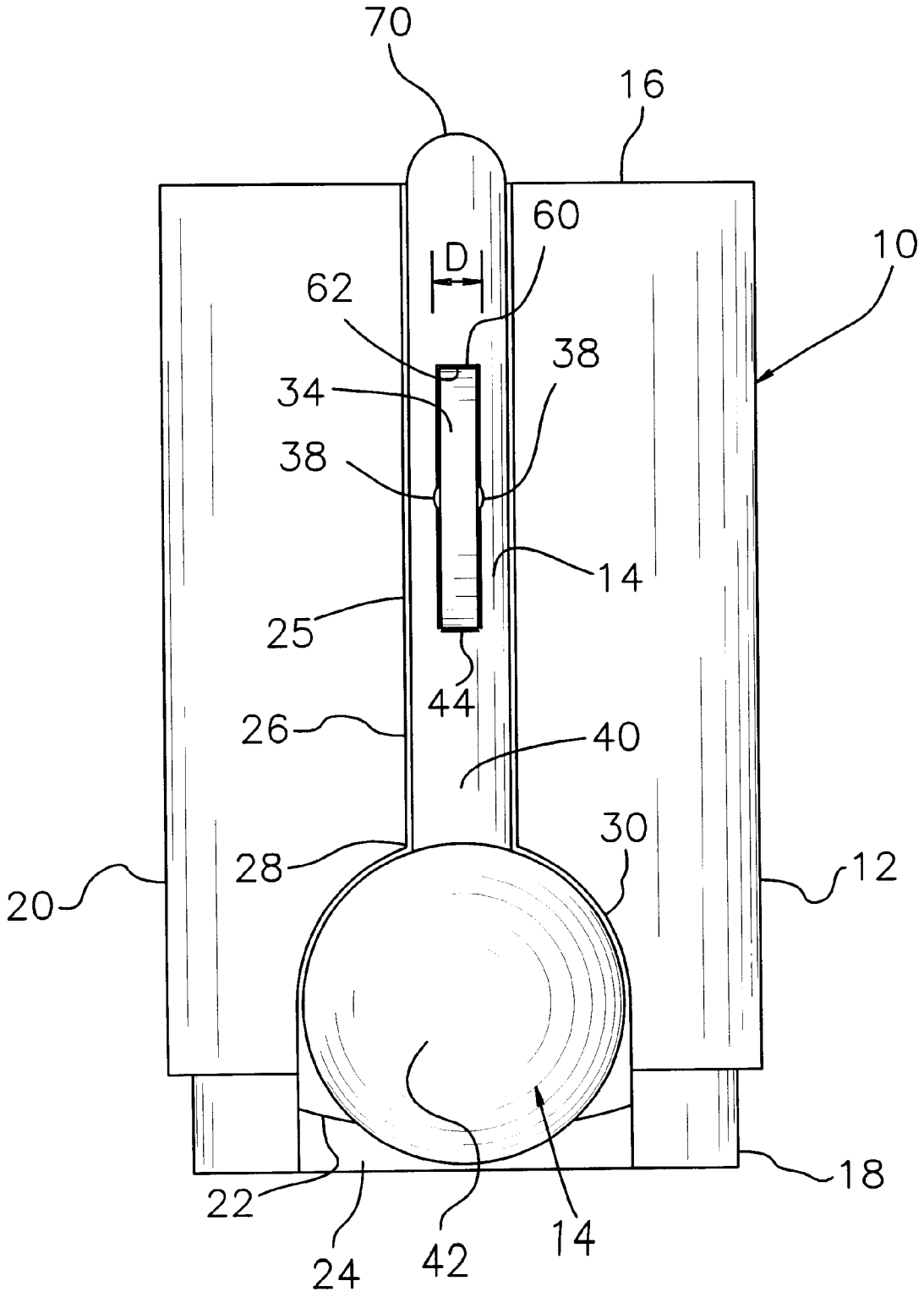
FIG. 2 is an elevational front view of the combined cup and utensil.
Figure 3:
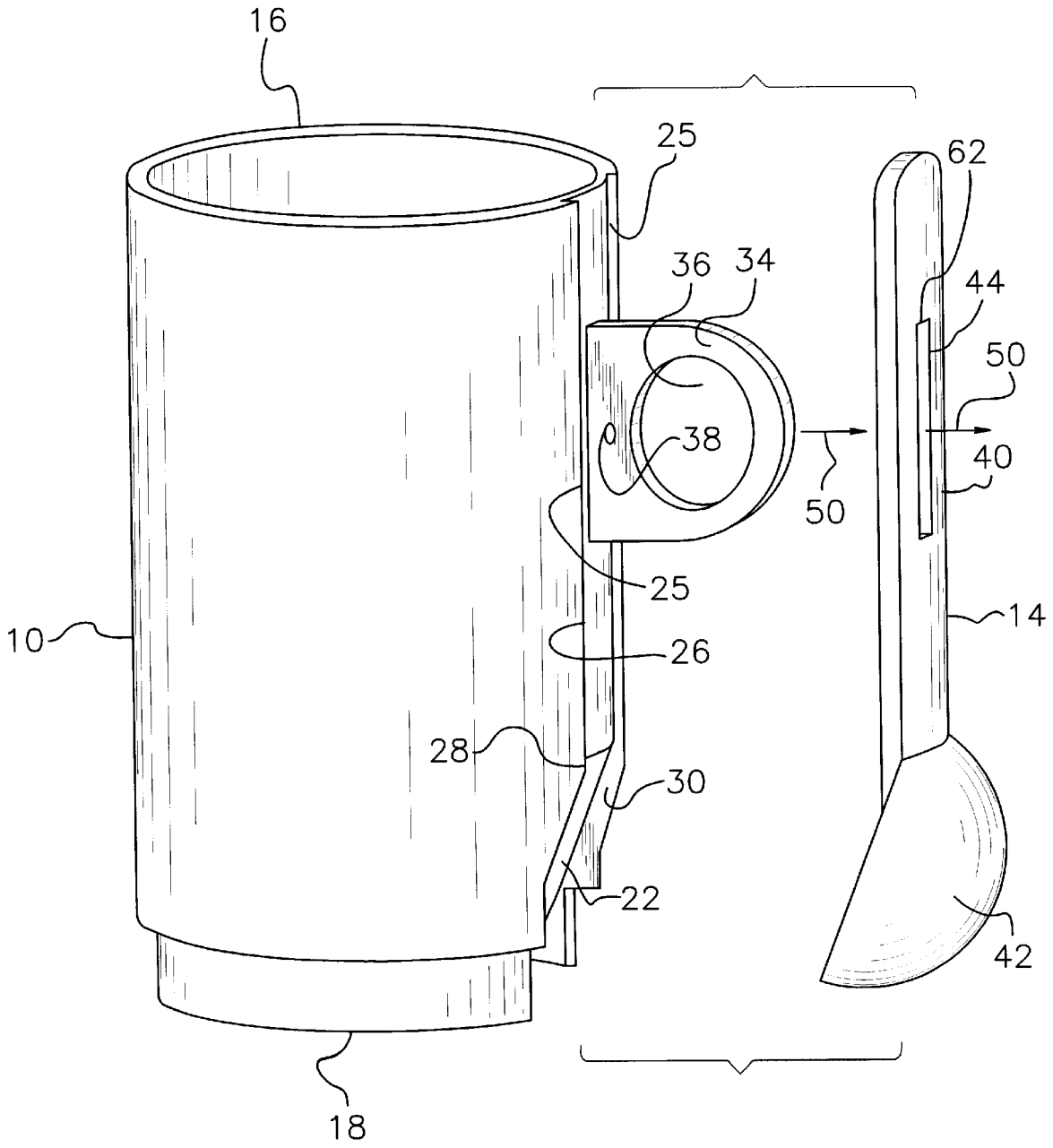
FIG. 3 is an exploded view of the cup and the utensil with the utensil removed from the cup.

There is shown in FIGS. 1–3 a combined cup and utensil device 10 which includes a drinking cup 12 and a releasably attached spoon 14. Cup 12 and spoon 14 are preferably composed of a molded plastic, although various other materials and manufacturing techniques may be utilized. The components should be manufactured from materials which are durable and resist easy breakage.

Cup 12 includes an open upper end 16 and a lower end 18 that engages a table or other supporting surface. The cup includes a generally cylindrical side wall 20 that extends between the lower and upper ends. The portion of side wall 20 proximate lower end 18 has a somewhat smaller diameter than the remainder of the side wall. In alternative embodiments, the cup may include a wide variety of other non-cylindrical shapes.

As best illustrated in FIGS. 2 and 3, cup 10 has a convex, closed bottom 22, which is recessed slightly from lower end 18. The cup bottom 22 is molded unitarily with side wall 20. As a result, when the cup sits on a table or other generally flat surface, a space 24 is formed between bottom 22 and the supporting surface, and between the cup bottom and side wall 20. This space may be eliminated in other versions of this invention wherein the cup bottom is formed at the lower end of the side wall. Space 24 is particularly desirable because it accommodates the head of spoon 14 when the spoon is attached to the cup in the manner described below.

As illustrated in FIGS. 1–3, a vertical channel 25 is formed longitudinally in the outer surface of side wall 20 of cup 12. Channel 25 includes a straight upper section 26 that extends from top end 16 to a point 28 along side wall 20. Channel section 26 is fairly shallow and includes a depth that is approximately ½ the thickness of side wall 20 of cup 12. This depth may be varied within the scope of this invention. However, straight channel section 26 is not formed fully through the side wall. Channel 25 further includes at its lower end a relatively wide section 30 that extends from point 28 to the lower end 18 of side wall 20. Wide channel section 30 extends completely through side wall 20 and thereby exposes curved bottom 22 in the manner best shown in FIG. 3.

A cup handle 34 is connected unitarily to side wall 20 within straight channel section 26. The cup handle includes a central opening 36 that accommodates the user's finger and permits the cup to be grasped in a comfortable, conventional manner. A pair of retaining protuberances 38 are molded or otherwise formed unitarily on opposing sides of handle 34. These elements, which may alternatively feature ribs, detents or other projecting structure, function in a manner that is described more fully below.

Spoon 14 includes an elongate utensil handle 40 having straight, parallel sides. Handle 40 generally conforms in shape to straight channel section 26 and has a width that is slightly less than the width of that channel section. A cup-shaped spoon head 42, generally conforming to the shape of wide channel section 30, is unitarily connected to one end of utensil handle 40. As best shown in FIGS. 1 and 3, the axes of the spoon head and spoon handle are formed at a slight angle to one another. Spoon 14 is composed of a durable plastic similar to the material composing the cup. Handle 40 is substantially flat and thin. As a result of this construction, the handle preferably exhibits at least a slight resilience. The upper end 70 of handle 40 is rounded, although in alternative embodiments, it may be blunt or include other shapes. Transversely, spoon handle 40 has a curved or rounded shape that conforms with the curvature of the outer surface of side wall 20.

An elongate slot 44 is formed through utensil handle 40. In the embodiment disclosed herein, the slot has a generally rectangular shape, although other shapes may be used in alternative embodiments. The slot should be long and wide enough to receive cup handle 34 therethrough. In its normal unstressed condition, slot 40 has a width that is slightly less than the distance D, FIG. 2, between the apexes of the respective protuberances 38. This helps to retain the utensil in interengagement with the cup in a manner described more fully below.

Cup 12 and spoon 14 are shown in a detached condition in FIG. 3. To releasably attach the spoon to the cup, the spoon is first positioned relative to the cup, in the manner shown in FIG. 3. More particularly, slot 44 in utensil handle 40 is aligned with cup handle 34. Spoon 14 is then mounted onto cup handle 34 by inserting the cup handle through slot 44, as indicated by arrows 50. As the inside edges of spoon handle 40 engage protuberances 38, the user pushes the spoon handle 40 inwardly toward channel section 26. This causes the spoon handle to flex slightly such that slot 44 expands. Protuberances 38 pass through the expanded slot and the spoon is snap fit into conforming channel 25 of cup 12. Likewise, spoon head 42 is generally conformably received within wide channel section 30 of cup 12. When this step is completed, the spoon 14 is mounted on cup handle 34 and interengaged with cup 12 is the manner shown in FIGS. 1 and 2. More particularly, after the protuberances 38 pass completely through slot 44, the sides of resilient handle 40 adjoining slot 44 return to their normal unstressed state, wherein the width of slot 44 is less than distance D. The protuberances thereby retain or hold handle 40 and entire spoon 14 securely within channel 25. As best shown in FIG. 2, the horizontal upper surface 60 of cup handle 34 interengages the flat upper edge 62 of spoon slot 44. As a result, the spoon depends from handle 34.

Because spoon head 42 is angled relative to the spoon handle, it is received neatly and efficiently within the space 24 formed around cup bottom 22. The spoon head protrudes only very slightly from side wall 20. Due to the curved transverse shape of the spoon handle 40, the interengaged utensil handle is virtually flush with the outer surface of side wall 20. A very clean, ergonomically efficient and aesthetically pleasing ornamental design is achieved.

While the spoon is connected to the cup in the above described manner, the cup may be used conveniently and comfortably for drinking. Spoon 14 does not protrude significantly from the upper end of the cup or radially from the cup. Likewise, the spoon is held snugly within the channel and does not interfere with the user grasping cup handle 34. As a result, the spoon does not first have to be removed from the cup when the cup is used for drinking. This contributes significantly to the convenience of this product and prevents unintended separation and potential misplacement and loss of the spoon. It also permits the spoon to be held securely to the cup as the entire product is washed in a dishwasher.

At certain times, the user may wish remove spoon 14 from cup 12. For example, the spoon may be needed for stirring or eating contents of the cup. To detach the spoon, the user simply grasps the upper end 70 of spoon handle 40 and pulls the spoon away from the cup in the manner illustrated by arrows 72 in FIG. 1. When a sufficient force is applied, the sides of utensil handle 40 adjacent slot 44 resiliently flex to expand the width of the slot. Protuberances 38 pass through the expanded slot 44 and the spoon 14 is pulled out of channel 25. The spoon is then conveniently removed from cup handle 14 and disengaged from the cup. See FIG. 3. The spoon and protuberances should be manufactured so that the spoon is securely retained on the cup and resists unintentional detachment. At the same time, the spoon should be removed relatively easily when the user pulls it apart from the cup.

Various alternative means may be used for retaining the utensil on the cup handle. For example, protuberances or detents may be carried by the utensil handle and complementary recesses may be formed in the cup handle for receiving such elements and holding the utensil in place. The utensil may also include recesses for receiving protuberances or other retaining elements carried by the cup handle. The cup channel may have various shapes and in some cases may be eliminated. Forks and knives may also be attached to a cup in the manner described herein.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A drinking cup and releasably attached eating utensil device comprising:

a cup;

a cup handle attached to and extending outwardly from said cup; and an eating utensil, which includes a slot through which said cup handle is received to selectively mount said utensil on said cup handle in interengagement with said cup.

2. The device of claim 1 in which said cup handle includes a generally horizontal upper support surface from which said utensil depends when said utensil is mounted on said cup handle.

3. The device of claim 2 in which said cup includes a generally vertical channel formed longitudinally in an outer surface of said cup, said cup handle being attached to said side cup said channel and said utensil fitting in said channel when said utensil is mounted on said cup handle.

4. The device of claim 3 in which said utensil includes an elongate utensil handle which is aligned and fits within said channel when said utensil is mounted on said cup handle.

5. The device of claim 1 in which at least one of said utensil and said cup handle includes means for retaining said utensil on said cup handle in interengagement with said cup until sufficient force is used to remove said utensil from said cup handle.

6. The apparatus of claim 5 in which said means for retaining include at least one retaining element carried by said cup handle and wherein said utensil comprises a resilient material that is selectively expanded by urging said utensil against each said retaining element to pass each said retaining element through said slot when a utensil is mounted on and removed from said handle.

7. The device of claim 5 in which a plurality of retaining elements are carried by said cup handle and wherein at least one retaining element is disposed on each side of said slot when said utensil is mounted on said cup handle.

8. The device of claim 4 in which said channel includes a substantially straight portion, which receives said handle of said utensil and a relatively wide portion, which receives a head of said utensil when said utensil is mounted on said cup handle.

9. The device of claim 1 in which said cup includes an upper end, a lower end and a side wall that extends between said upper and lower ends.

10. The device of claim 9 in which said cup includes an opening formed at the upper end and a closed bottom that is recessed from the lower end.

11. The device of claim 10 in which said side wall includes a generally vertical channel that extends from said upper end to said lower end of said side wall, said cup handle being attached to said side wall within said channel, said utensil being received within said channel when said utensil is mounted on said cup handle.

* * * * *